United States Patent [19]

Richardson

[11] 4,016,690

[45] Apr. 12, 1977

[54] STRUCTURAL MEMBERS FOR PANEL WALL AND GLAZING SYSTEMS

[76] Inventor: Cletus Richardson, 3419A Winnebago, St. Louis, Mo. 63118

[22] Filed: Apr. 21, 1975

[21] Appl. No.: 570,248

[52] U.S. Cl. ..... 52/238; 52/282; 52/479

[51] Int. Cl.[2] ..... E04H 1/00

[58] Field of Search ..... 52/210, 211, 238, 243, 52/241, 281, 282, 399, 400, 656, 731, 475, 479

[56] References Cited

UNITED STATES PATENTS

| | | | |
|---|---|---|---|
| 998,620 | 7/1911 | Leonard | 52/399 |
| 2,909,814 | 10/1959 | Schwartz | 52/399 |
| 2,958,403 | 11/1960 | Robertson | 52/241 |
| 3,001,248 | 9/1961 | Verhagen | 52/399 |
| 3,126,986 | 3/1964 | Madl | 52/241 |
| 3,136,395 | 6/1964 | Rebelle | 52/282 |
| 3,312,032 | 4/1967 | Ames | 52/731 |
| 3,339,324 | 9/1967 | Stackhouse | 52/241 |
| 3,418,773 | 12/1968 | Sarvay | 52/400 |
| 3,438,164 | 4/1969 | Duepree | 52/282 |
| 3,501,883 | 3/1970 | Birum | 52/241 |
| 3,537,219 | 11/1970 | Navarre | 52/241 |
| 3,593,475 | 7/1971 | LaGue | 52/241 |

FOREIGN PATENTS OR APPLICATIONS

| | | | |
|---|---|---|---|
| 289,828 | 10/1966 | Australia | 52/731 |
| 1,226,536 | 3/1971 | United Kingdom | 52/399 |

*Primary Examiner*—Price C. Faw, Jr.
*Assistant Examiner*—Carl D. Friedman
*Attorney, Agent, or Firm*—Gravely, Lieder & Woodruff

[57] ABSTRACT

A wall or partition system in which panels are supported by structural members to make up a full height wall or a low partition space divider, in which structural members embrace the margins of the panels, in which the structural members are useable with glazing stops to mount glass panels or panes, and in which the structural members have unique physical configuration which carry out the assembly schemes of simplicity and economy.

7 Claims, 12 Drawing Figures

FIG. 1
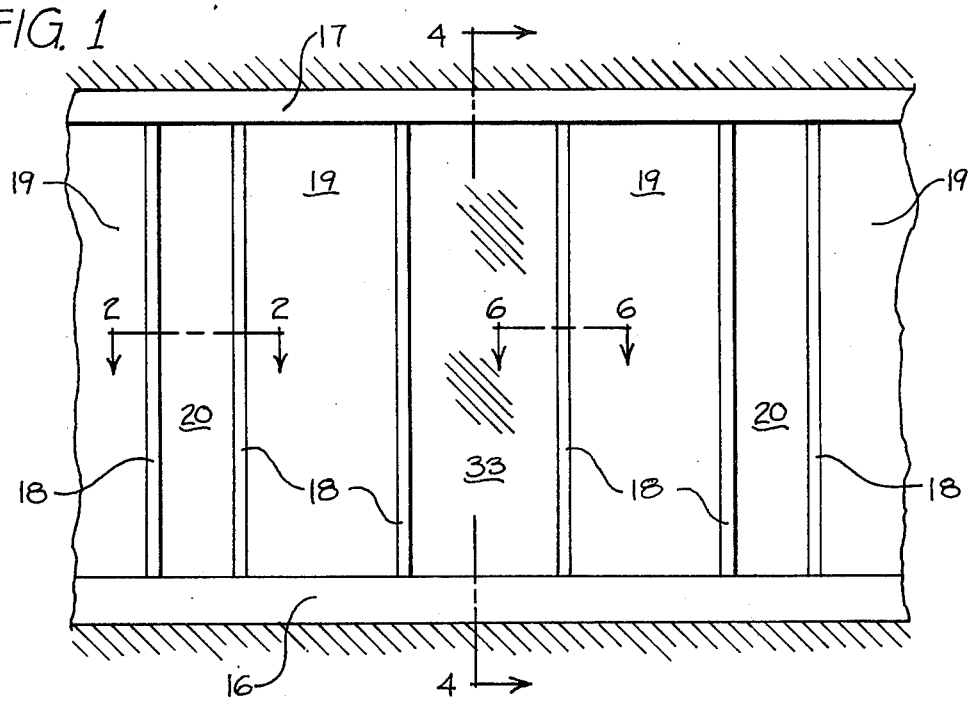
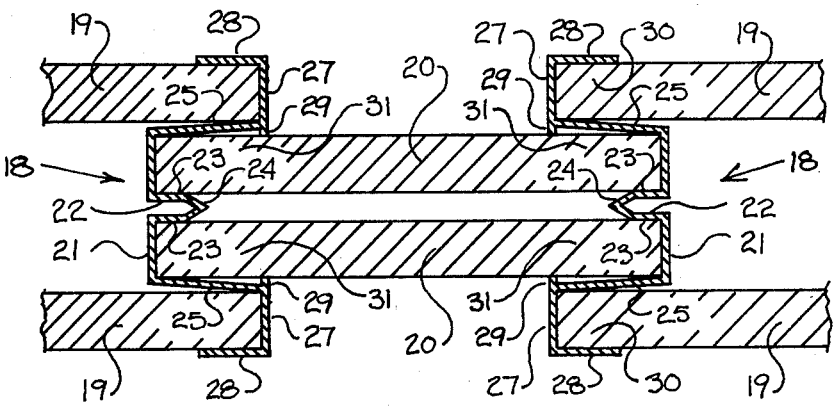
FIG. 2
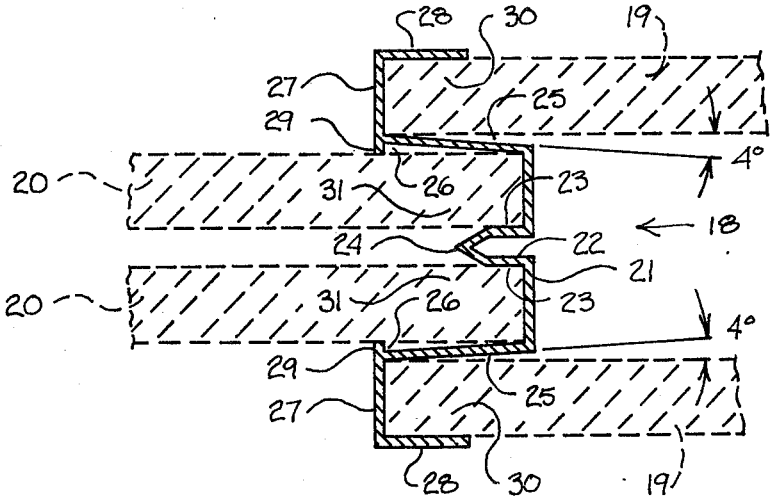
FIG. 3

STRUCTURAL MEMBERS FOR PANEL WALL AND GLAZING SYSTEMS

BACKGROUND OF THE INVENTION

This invention relates generally to panel wall systems and glazing means for such systems, but particularly to structural members to facilitate the erection and support of panels of glazing in such walls.

Heretofore, wall systems made up of structural members to support and frame panels of any of the veneer, pressed wood or plaster sheets have been erected with complicated members which require a fairly high level of experience to erect and which entails considerable expense in the manufacture and in the installation. The objections raised to such prior wall systems presents a challenge to those skilled in this art. This challenge has been partially met by the improvements set out in my prior U.S. Pat. No. 3,629,984, granted Dec. 28, 1971. The present invention embodies several unique improvements over my prior patent in that the systems allows greater versatility in wall or partition layup, and employs structural member which have several different uses, thereby extending the range of applications of the system with minimum cost.

The general character of a panel wall system having the strength and sound reducing advantages of double thickness panels requires floor supports, vertically directed structural members of the improved character hereof, and panels set in and supported by the vertical members. When the panels reach up to a ceiling, then there is a ceiling support vertically aligned with the floor support. In addition to the supports and structural members, when the panels are to be replaced by glass, the usual system is provided with special framing members which must be made compatible with the channels and studs. As far as I am aware the prior wall systems do not have universally adaptable members that are capable of use either for erecting a double panel wall or for a glass panel in such a double panel wall. The prior systems generally require additional members of complicated form which increases the expense of the wall system and requires erection training to accomplish its purposes.

In contrast to the prior art, this invention has as its principal object the provision of a structural member for a wall system of the foregoing character which is useful without change for supporting panels and glazing, whereby fewer parts are necessary and cost savings may be realized.

It is also an object to provide structural members interchangeably useful in the erection of double panel walls and also useful in the installation of glass in walls.

It is another object of this invention to provide a family of structural members for the erection of walls formed of either full height or partial height panels, in which the members cooperate to make it extremely simple to fit the members and panels in assembly.

In one presently preferred embodiment of this invention a structural member for wall panel or glazing systems comprises a plastic or metallic body providing a pair of side by side inner channels spaced apart by a median rib, a pair of outer channels, one on the outside of each of said inner channels, so that there is a common support between an inner and an outer channel, base walls on said body closing one end of each of said inner channels, and exposed face walls on said body closing one end of each of said outer channels, said base walls and face walls being spaced apart such that the inner channels open in a direction opposite to the outer channels.

Another embodiment is found in the interchangeable use of a structural member as a support of low partition walls and as a substitute for certain panels in a full height wall system, all as is set forth in the following specification.

BRIEF DESCRIPTION OF THE DRAWINGS

Presently preferred embodiments of the structural member in this wall and glazing system is shown in the accompanying drawings, wherein:

FIG. 1 is an elevational view of a portion of a wall system erected with the use of the structural member of this invention;

FIG. 2 is a fragmentary sectional view of a portion of the wall of FIG. 1 as seen along line 2—2 therein;

FIG. 3 is an enlarged sectional view of the present structural member, and in which wall panels are seen in phantom outline;

DETAILED DESCRIPTION OF THE EMBODIMENTS

Figure 4:
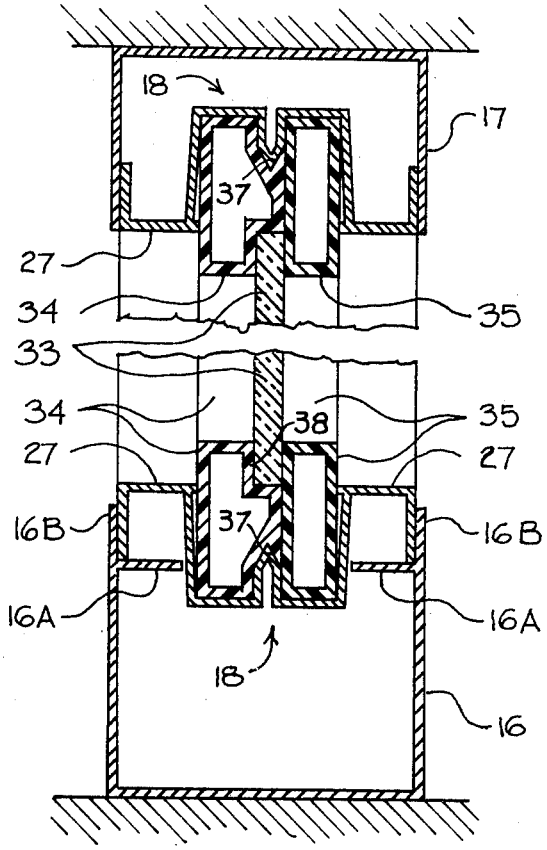
FIG. 4 is a fragmentary sectional view of a glass panel mounted in the present structural members, the view being taken at line 4—4 in FIG. 1 to illustrate the versatile nature of such member.

The structural members 18, which is the special feature of this invention, are seen in FIG. 1, and in more detail in FIGS. 2 and 3. The member 18 is an elongated body of aluminum or plastic formed in any suitable manner. The various parts of the member 18 include a base wall 21 interrupted by a median rib 22 having side surfaces 23 perpendicular to said base wall 21 and an apex 24. The rib 22 is flanked by side walls 25 extending to the same side of the base wall as the rib 22 and angularly divergent from the base wall by approximately 4° more or less off the perpendicular. The side walls 25 extend beyond the rib 22, and each is connected at its outer margin 26 to a face wall 27 which extends outwardly to a side flange 28. Each face wall 27 is parallel to the base wall 21 but spaced therefrom by the length of the divergent side wall 25. Each face wall 27 extends inwardly of the end 26 of the side wall to provide a lip 29.

The foregoing description has pointed out the characteristic portions of the structural member 18. When used to support wall panels 19 the vertical margins of the panels 19 (FIG. 2) are inserted in the outer channels 30 formed between the side flanges 28 and the divergent side walls 25. As the panel margins slide into these channels 30 there is a wedging action imposed thereon due to the side walls 25 being angularly related to the flanges 28. This wedging action is depicted in FIG. 3 with the panel margins shown in phantom outline, and a particularly desirable result is that the side flanges 28 are positioned flush against the side of the panels and prevent unsightly gaps.

Still referring to FIGS. 2 and 3, the wall panels 20 are positioned with the vertical margins inserted into the adjacent inner channels 31 separated by the median rib 22. The side walls 25 being angularly related to the side surfaces 23 of the rib 22, the panel margins are wedged into final position in the inner channels. The angular relation of the side walls 25 to the plane of the wall panels 20 results in the formation of a gap, and these gaps are effectively closed by the inwardly directed lips 29 on the face walls 27. In the view of FIG. 2, it is seen that the face walls 27 and side flanges 28 are exposed to view at either side of the panel wall while the portions 21, 22 and 25 of the body of member 18 are hidden from view. The side walls 25 are deeper (or wider) than the outer flanges 28 so that a substantial overlap of the panels 19 and 20 is achieved to establish an assembly having considerable resistance to side loads that may be imposed on or exerted against the wall.

The structural member 18 above described has special utility in that the medial rib 22 acts to retain the inner wall panels 20 in spaced relation to form a sound deading closed chamber in the interviewing space. The members 18 also supports the outer panels 19 in proper spaced positions so that standard receptacles and electrical junction boxes (not shown) will be accommodated in either wall panel 19 without penetrating the opposite wall panel.

Figure 5:
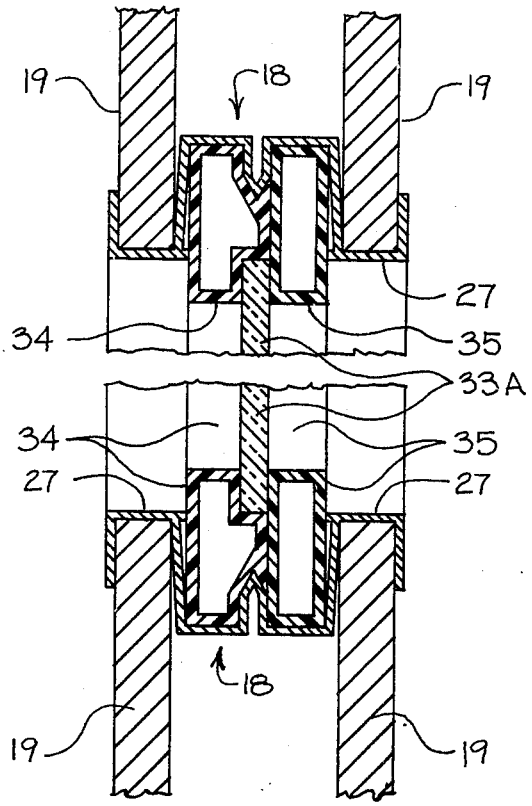
FIG. 5 is an enlarged and fragmentary sectional view similar to FIG. 4 but of a modified glazing assembly.

Turning now to FIGS. 4 and 5, it can be seen that the structural member 18 has further highly useful applications for the support of glass panels 33. When it becomes desirable to substitute a glass panel 33 for the inner wall panels 20 of FIG. 2, the floor mounted baseboard channel 16 is adapted to receive a proper length of member 18 set horizontally so that the base wall 21 passes between and below the flanges 16A in the channel 16, while the face walls 27 remain exposed above the margins of the lips 16B on the channel 16. Each vertical side of the glass panel 33 is received in the members 18 in a manner to be described in connection with FIG. 6, but in general the support of the glass is obtained by glazing stops 34 and 35. The upper margin of the glass panel 33 is mounted in a horizontally positioned member 18 placed in the ceiling channel 17. Thus, the glass panel 33 is framed on all margins by the members 18, together with the placement of the glazing stops 34 and 35.

Figure 6:
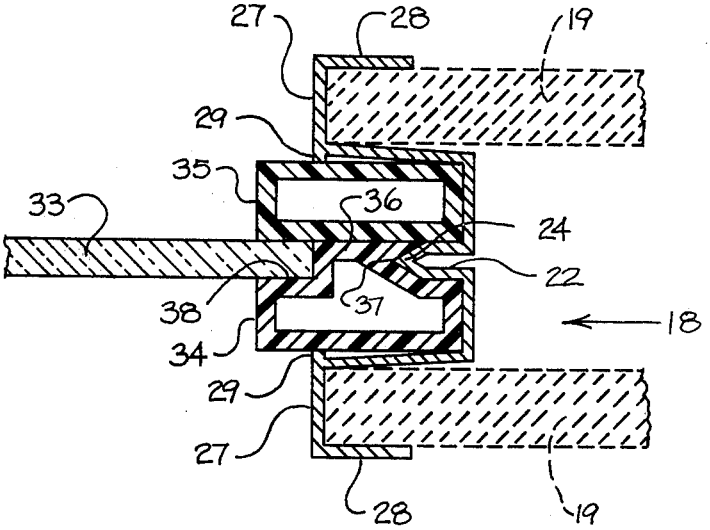
FIG. 6 is a fragmentary section view of the glazing assembly taken at line 6—6 in FIG. 1.

FIG. 6 shows in enlarged detail the typical arrangement of glazing stops 34 and 35 in the member 18. After the members 18 are placed in position to frame the opening, the first glazing stops 34 are fitted into aligned inner channel 31. The stop 34 may be a plastic material or an expanded foam strip, or rubber. As shown the stop has an inner wall 36 with a groove 37 which seats on the apex 24 of the median rib 22. The wall 36 is further formed with an outer notch 38 which is slightly above the plane of the face walls 27 and of a width less than the glass thickness. Each member 18 is provided with a similar stop 34 so that the notches 38 form a seat slightly smaller than the opening defined by the several face walls 27. The glass panel 33 is cut to a size that will just clear the respective face walls 27 so the margins fit into the notches 38. The closing stop 35, also formed of a like material and generally rectangular in shape, is placed in the opposite channel so it will lie flush against the glass rather than abut the stop 34 below the notch and be retained by the inwardly directed lip 29 on the adjacent face wall 27. As noted above, the glazing stop assembly shown in FIG. 6 is typical at all margins and illustrates the further utility of the member 18 described in detail in FIG. 3.

In view of the disclosure in FIGS. 4 and 6, the assembly in FIG. 5 will be better understood, for here the glass panel 33 does not extend the full height of the walls, but is extended only part way vertically in a wall assembly of the character seen in FIG. 1. In this case, the wall panels 19 are interrupted in their vertical length and a structural member 18 is mounted horizontally so that the channels 31 open upwardly in face relation to an overhead horizontal structural member 18 having its channels 31 facing downwardly. Of course, the opposite vertical structural members 18 will be present in the opening in the manner shown in FIG. 2 so that a glass panel 33A will be supported around its perimeter by the notched glass stops 34 and the cooperating glass stops 35, all as particularly described in FIGS. 4 and 6. The glass panel 33A may be located as desired between any pair of vertical oriented structural members 18 so as to form a window in the wall assembly of the characteristic seen in FIG. 1.

Figure 7:
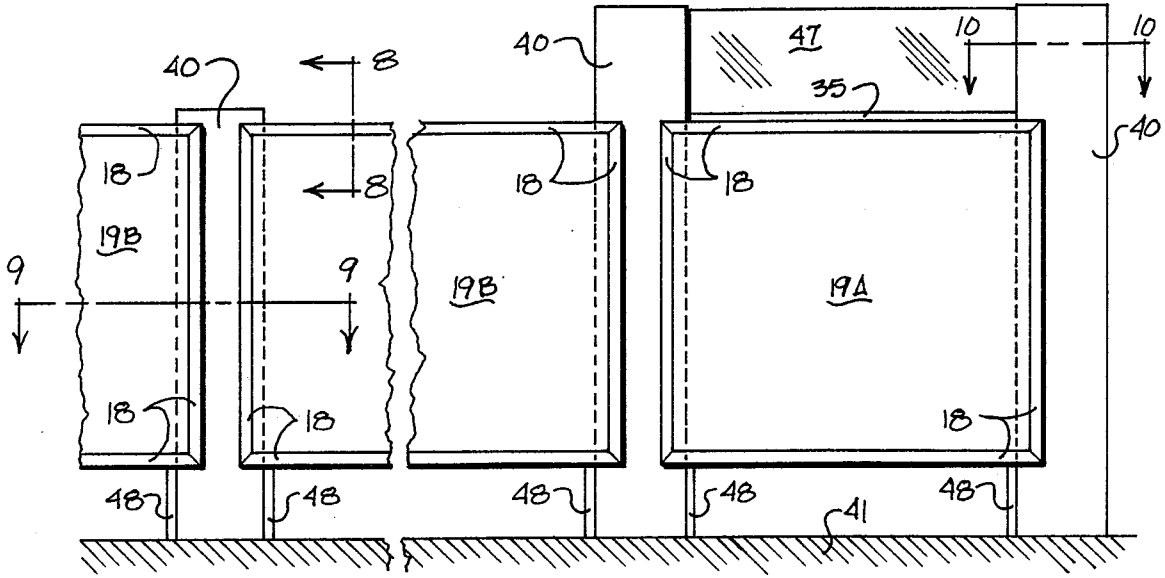
FIG. 7 is a fragmentary elevational view of a low partition wall showing further applications of the present structural member.
Figure 8:
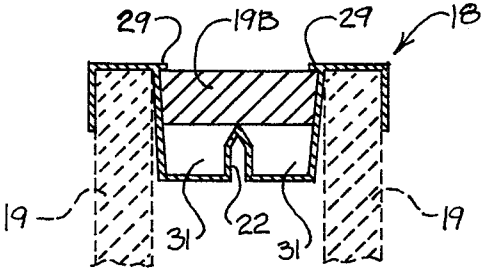
FIG. 8 is a view taken at line 8—8 in FIG. 7.
Figure 10:
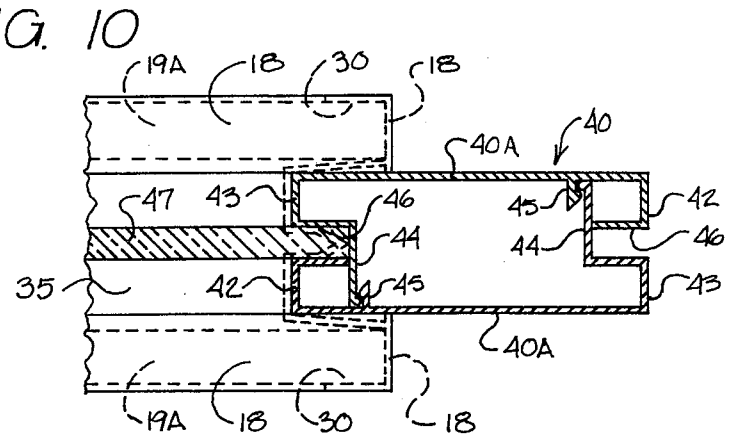
FIG. 10 is a further view taken at line 10—10 in FIG. 7.

Turning now to the several views of FIGS. 7 through 10, it can be seen that the structural members 18 may be utilized in a noval way to make up a low wall or partition, and the characteristics of the assembly will now be described. In FIG. 7 structural posts 40 are suitably anchored to a floor 41, and each post is made up of two identically shaped but reversely interconnected portions 40A. Each portion 40A is provided with a return bend 42 at one end and with a return bend 43 at the opposite end, but the return bend 43 is also formed with a spacing flange 44 which is adapted to interlock at a retainer lip 45 while at the same time holding the adjacent return bends 42 and 43 spaced apart so as to form an elongated groove 46. The space between the vertical posts 40 is closed by a pair of panels 19A supported along their vertical margins in the outside channels 30 of a short length of the structural member 18. These structural members 18 receive the interlocked portion 40A of the adjacent posts within the interior channels 31 so that the medial rib 22 fits into the groove 46, thereby fully interlocking structural members 18 with the respective posts 40. The horizontal bottom margins of panels 19A are supported in a short length of structural member 18 which is directed horizontally between the posts 40, and a similar structural member is disposed horizontally on the upper margins of panel 19A. The posts 40 may extend a suitable distance above the upper horizontal margins of panels 19A so as to receive a glass partition 47. The partition 47 is suitably supported in the upwardly opening inner channels 31 of a horizontal structural member 18, along with the glass stops 34 and 35. The opposite vertical margins of the glass partition 47 are received in the grooves 46, one such assembly being seen in FIG. 10.

It is also seen in FIG. 7 that adjacent panels 19B may be mounted in a manner described for panels 19A, except that the vertical posts 40 do not extend above the upper horizontal margin in panels 19B to the same degree as other posts 40 are required to extend for the purpose of supporting glass partitions 47. In the case of the low wall made up of panels 19B the upper horizontal placement of the structural members 18 will leave the interior channels 31 open, and in FIG. 8 these open channels 31 may be suitable closed by inserting a piece of the panel 19B such that its finished surface is exposed. This closure for the channels 31 is suitably supported on the apex of the medial rib 22. Of course, other material may be utilized to close the upwardly opening channels 31, and whatever means is employed will be suitably retained between inwardly projecting lips 29.

Figure 9:
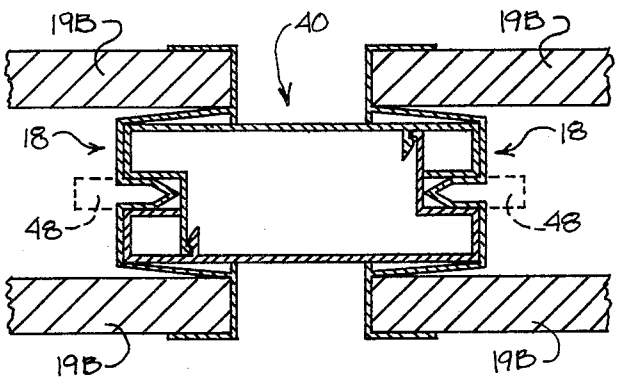
FIG. 9 is a view taken at line 9—9 in FIG. 7.

FIG. 9 provides a fragmentary detail of the assembly on a vertical post 40 of the vertically directed structural members 18 which support pairs of panel sections 19B.

The lower horizontal members 18 in the view of FIG. 7 are supported against sliding down on the posts 40 by the placement of suitable length blocks 48 which are placed in the grooves 46 so that the rib 22 will rest on these blocks. A portion of each block 48 will be exposed to view and therefore may be given a desired surface treatment to match with the scheme of the assembly.

Figure 11:
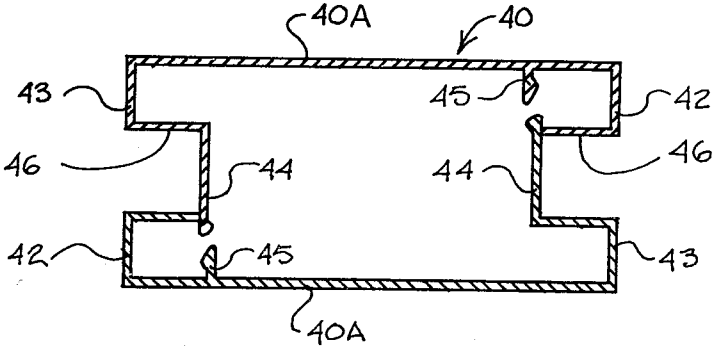
FIG. 11 is a sectional view of the post of FIG. 10 in a partially assembled position of its two parts.

In FIG. 11 there is shown the assembly of the posts 40 in which two identically shaped by reversely interconnected components 40A are located in position to be pressed into final assembly. It is necessary for the two parts 40A to have the side walls formed with right angular flanges 42 and 43 directed reversely so that the flange extensions 44 will have the free ends thereof snap fit into the notches of the retainers 45, and at the same time the length of the flange extensions 44 will establish the spacing of the flanges 42 and 43 to set the width of the respective grooves 46 formed between these flanges 42 and 43. While the structural member 40 is shown in FIG. 9 to furnish support for adjacent low panels 19B, it can be appreciated that the structural member 40 may also be utilized in a wall layup assembly arrangement show in FIG. 2 where it will replace the recessed panels 20. The suitability for substituting the structural member 40 for the panels 20 will usually occur when it is desired to have substantial strength at certain intervals in a wall run so as to increase the ability of the wall to withstand vertical or lateral loads.

Figure 12:
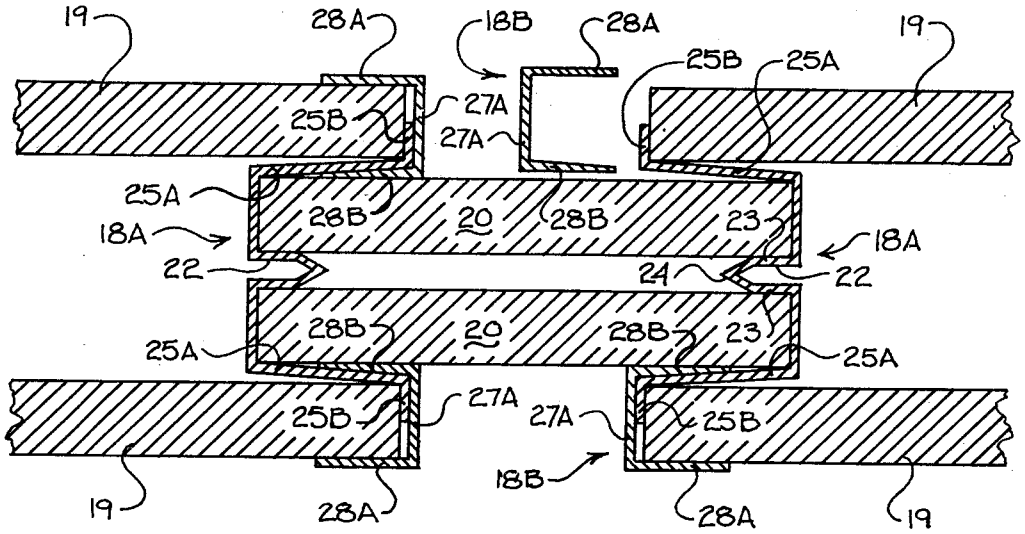
FIG. 12 is a fragmentary sectional view of a portion of a wall assembly showing the installation of a modified structural member.

A particularly important feature of the structural members shown and described in FIGS. 2 and 3 is shown in the embodiment of FIG. 12 where the above described one-piece structural member 18 may be fabricated so as to have cooperating components inwhich the principal component is shown at 18A and the supplemental components are shown at 18B. The component 18A is formed, as before, with the base wall 21 interrupted by a median rib 22 having surfaces 23 perpendicular to the based wall 21 and extending outwardly therefrom to an apex 24. The rib 22 is flanked by outwardly spaced side walls 25A which extend beyond the rib 22 and are formed with outwardly directed flanges 25B. This component 18A, as shown, is adapted to receive the margins of panels 20 as previously described. The components 18B which are separately formed are individually assembled. In some wall systems it is preferred to be able to insert panels 19 after the structural components 18A and panels 20 have been erected. In order to accomplish this desirable feature and still have the structural intergity throughout the wall system, the components 18B are designed to be installed separately. As shown in FIG. 12, each of the components 18B is formed with a face wall 27A, an outside flange 28A, and an inside flange 28B, with the flange 28B directed at an angle to the outside flange 28A so as to properly mate with the angularity of the adjacent side wall 25A on the component 18A. It can be seen in this view that after the wall panel 19 has been positioned with its margin against the flange 25B the component 18B is positioned with the flange 28B directed into the notch formed between the panel 19 and the angular wall 25A. At the same time the outside flange 28A is directed so as to pass over the exposed surface of the panel 19. The component 18B is pushed into position and is so retained because of the tight fit that results. It is helpful to, at times, roughen the abutting surfaces of the parts 25A and 28B so as to increase the retention of these parts. Furthermore, the part 28B will be caused to wedge itself into the space between the panel 20 and the wall 25A, and this wedging action will increase the surface contact so that the component 18B will be retained in the desired position. As far as the visible positions of the structural members seen in FIG. 12 is concerned it will look exactly like the assembly shown in FIG. 2. The difference, however, is that the assembly of FIG. 12 may be taken apart by removing the components 18B, and this disassembly feature will permit inexpensive modifications in a wall layout, whereas the assembly of FIG. 2 will require destruction of at least one or two panels before it may be disassembled. Furthermore, the assembly of FIG. 2 must be effected progressively along the length of a wall run, whereas in FIG. 12 the panels 19 may be inserted by being moved directly into position and without the necessity of installing the panels 19 shown at the left of FIG. 12 before installing the panels 19 seen at the right, or vise versa in relation to the position of the panels 20 and the supporting structural components 18A.

In view of the above described wall lay up shown in FIG. 1 and shown in FIG. 7, it will be now understood that a combination wall lay up may be constructed in which the alternate panels 19 and 20 may be supported by the structural members of the character seen in FIG. 2, and at suitable places the panels 20 may be replaced by a structural member of the character seen in FIG. 9. Thus, the features seen in FIGS. 1, 2, 4, 5, 7, 9 and 12 may be intermingled as desired, and the details of form and construction are herein above set forth in sufficient detail to enable the advantages of my improvements to be obtained.

The foregoing description has set forth the important characteristics of the novel and unique structural members for supporting selectively pairs of wall panels or combinations of wall panels and glass panels. It has been pointed out that the structural member is characterized by a body having oppositely opening inner and outer pairs of channels in which the inner pair of channels is divided by a projecting rib and the outer pairs of channels have a common wall with the inner channels, which common wall is angularly divergent so as to receive and wedge the margins of adjacent wall panels into close fitting relation especially in the outer channels which are exposed to view.

It is understood of course, that there may be certain modifications in the characteristic configuration for the structural members which have been disclosed in presently preferred embodiments, and any such modifications are to be included within the scope of the invention.

What is claimed is:

1. A structural member for supporting a plurality of panels in a panel wall lay up: each structural member comprising a body formed of substantially rigid material having uniform thickness and having a base wall formed with spaced apart side walls at the opposite margins, a rib on said base wall, said rib being of less length than said side walls and said rib and side walls projecting to the same side of said base wall and forming a pair of adjacent channels, said rib having an apex positioned for directing margins of a pair of wall panels into said channels, said rib holding the wall panels against said side walls in spaced relation; and means cooperating and being integral with each of said side walls for forming other channels for receiving the margins of additional wall panels, each said cooperating means being formed with a face wall engaged with said side wall and a flange spaced outwardly from a side wall and directed reversely thereto to form said other channels opening oppositely to the first mentioned channels, said side walls being angularly divergent as measured from said base wall so as to present to the margins of the wall panels a wedging surface on its opposite sides common to all of the channels, each of said flanges being of less dimension than said side walls to expose a portion of said side walls for directing the margins of a pair of wall panels into said other channels, each of said face walls engaged with said side walls being formed with a lip extending into the adjacent channel of said pair of adjacent panels to compensate for the angular divergence of said side walls and close the gap with an adjacent panel.

2. A wall lay up comprising, in combination, wall panels, and structural members for supporting the margins of said wall panels, said structural members each having an elongated body formed with a base wall, side walls projecting in the same direction from opposite longitudinal sides of said base wall and terminating in face walls which extend in opposite directions from each other and are generally parallel with said base wall, a flange on each face wall directed generally normal to said face wall and spaced outwardly of and overlapping said side wall, said flange on each of said face walls and the adjacent side wall forming an outer channel at each longitudinal side of said side wall and said outer channels open in the same direction, and a rib carried on said base wall projecting outwardly generally perpendicular to said base wall and located between said side walls to form inner adjacent channels opening from said base wall opposite to said outer channels, each of said side walls being angularly divergent relative to said flanges and said rib, thereby imparting a wedge configuration throughout the depth of each of said channels, said wall panel margins being directed by said angularly divergent side walls into close fitted relation with said rib and with said flanges, and said rib having angularly divergent apex surfaces to direct the panel margins into said inner channels, and a lip on each of said side walls co-extensive with said face walls and directed toward each other oppositely of said face walls to project into said adjacent channels such that each of said lips engages the margin of an adjacent wall panel to compensate for the angular divergents of said side walls.

3. A wall lay up comprising wall forming panels positioned in spaced relation, panel supporting members formed with first channels opening in the same direction and which receive the margins of the panels and second channels separated by a rib and opening oppositely to said first channels, and a structural member comprising a pair of similar cooperating components having side walls with opposite margins ending in right angular flanges, a flange extension on one right angular flange of each component being directed toward the interior of the side wall of the other component, and a locking lip on the interior of the side wall of each cooperating component being in position to engage and become interlocked with the said one flange extension on said cooperating components, said flange extensions being elongated to position said right angular flanges of a pair of cooperating components in spaced relation to form a recess therebetween, said panel supporting members and structural member being engaged through said rib in said second channels engaging in said recess.

4. A panel wall lay up comprising, in combination, a plurality of panel supporting members spaced along the length of the wall lay up, each of said panel supporting members being formed with a first pair of adjacent channels opening in the same direction and separated by a rib and a second pair of spaced channels separated by said first pair of adjacent channels and opening in the same direction but oppositely to said first pair of adjacent channels, said panel supporting members being arranged in the wall lay up in spaced relation so that said first pairs of adjacent channels in a first pair of panel supporting members are in facing relation and said second pair of channels in a second pair of panel supporting members are in facing relation but opposite to said first pairs of adjacent channels, wall panels mounted with margins received in each of said facing second channels, and other wall forming panels disposed with marginal portions thereof engaged in said first pairs of adjacent channels in said first pair of panel supporting members and filling the space between said first members, said other wall forming panels being spaced apart by said rib and said wall panels being spaced apart by said other wall forming panels.

5. In a wall lay up, the combination of: a pair of wall panels having vertical side margins and top horizontal margins, wall panel supporting members each formed with spaced channels and being arranged to receive the vertical side margins of said pair of wall panels and retain them in spaced relation, a top member formed with spaced outer channels and an inner spaced between said outer channels, said inner space having an open side opening oppositely to said outer channels, said outer channels being fitted over the top horizontal margins of said pair of wall panels and thereby exposing the open side of said inner space between and adjacent the top horizontal margins of said pair of wall panels, a filler member disposed in said inner space to close the open side of said inner space, said filler member being formed of the same material as said wall panels and said top member and supporting members having substantially the same shape so as to place said spaced channels and outer channels thereof in alignment to hold said wall panels in spaced relation and a rib element disposed in said inner space and projecting toward said open side thereof, said rib element supporting said filler member, and lip elements at said open side of said top member in position to retain said filler member in position adjacent said open side.

6. In a wall lay up the combination of: vertically and horizontally engaged and cooperating structural members framing a rectangular opening, each of said structural members being formed to provide a pair of inner channels separated by a rib and a pair of outer channels separated by said inner channels, said inner channels opening oppositely to said outer channels; wall panels supported by certain of said structural members by the margins thereof being inserted in said outer channels, said inner channels of said vertical and horizontal structural members being in alignment about the rectangular opening; a first set of glazing stops having a notch formed therein and the notches together defining the margins of said rectangular opening; a glazing panel mounted in said rectangular opening on said first glazing stop notches; and a second set of glazing stops disposed in the other of the aligned inner channels of each structural member and engaged against said glazing panel, said ribs in each inner channel cooperating with said first and second glazing stops to maintain alignment thereof in said pair of inner channels.

7. The combination set forth in claim 6 wherein said glazing stop notches define an opening smaller than said rectangular opening framed by said structural members, and said inner channels being deeper than said outer channels to present a surface adjacent said outer channels to be engaged by and guide said wall panels into said outer channels.

* * * * *